US005237931A

United States Patent [19]

Riedl

[11] Patent Number: 5,237,931

[45] Date of Patent: Aug. 24, 1993

[54] TRANSPORTATION SYSTEM FOR CITY TRANSPORTATION WITH TRACTION CABLE AND RAILROAD SYSTEM HAVING A CENTRAL ROUTING CONTROL AND ELECTRONIC CALLING SYSTEMS IN THE STATIONS

[75] Inventor: Norbert Riedl, Rudengasse, Austria

[73] Assignee: Waagner-Biro Aktiengesellschaft, Austria

[21] Appl. No.: 964,417

[22] Filed: Oct. 21, 1992

Related U.S. Application Data

[63] Continuation-in-part of Ser. No. 697,101, May 8, 1991, abandoned.

[30] Foreign Application Priority Data

May 8, 1990 [AT] Austria ..... 1032/90

[51] Int. Cl.[5] ..... B61B 1/00; B61B 9/00

[52] U.S. Cl. ..... 104/28; 104/88; 104/91; 104/173.1

[58] Field of Search ..... 104/28, 87, 88, 89, 104/91, 96, 130, 173.1

[56] References Cited

U.S. PATENT DOCUMENTS

| | | | |
|---|---|---|---|
| 2,344,155 | 3/1944 | McBride et al. | 104/91 |
| 3,174,438 | 3/1965 | Hariton | 104/88 |
| 3,403,634 | 10/1968 | Crowder | 104/28 X |
| 3,675,584 | 7/1972 | Hall | 104/28 |
| 3,788,232 | 1/1974 | Schneider et al. | 104/88 |
| 3,858,518 | 1/1975 | Nyman | 104/88 |
| 4,083,309 | 4/1978 | Gerard | 104/18 |
| 4,147,235 | 4/1979 | Henry et al. | 187/102 |
| 4,308,935 | 1/1982 | Deric | 187/102 |
| 4,641,587 | 2/1987 | Dalliard | 105/3 |
| 4,662,479 | 5/1987 | Tsuji et al. | 187/131 |
| 4,745,865 | 5/1988 | Dehne | 104/172.3 |
| 4,958,574 | 9/1990 | Meindl | 104/88 |
| 5,069,140 | 12/1991 | Glassey | 104/28 |

*Primary Examiner*—Robert J. Oberleitner
*Assistant Examiner*—S. Joseph Morano
*Attorney, Agent, or Firm*—Steinberg & Raskin

[57] ABSTRACT

In a transportation system for city transportation in which the cars are moved on a rail system and are brought at least part of the time into circulation from a circulating traction cable and the cars are fastened with clamps on the traction cable, stations are arranged at any given distance between the end railway stations with reversing devices for the traction cable, cars come to stand on a secondary track at the stations, and the through traffic has the ability to pass the standing cars. In the individual stations, an electronic calling system is installed which in cooperation with a central control causes a next car with a free place to seek the stations and to pick up the passenger(s), or to transfer a further car or car train into the rail system. In the cars themselves are provided station selection devices for the next stop. The secondary track is preferably arranged above or below the through rail system. The stations are thereby simplified, and it is possible to enter the stopping car directly, similar to a platform.

13 Claims, 1 Drawing Sheet

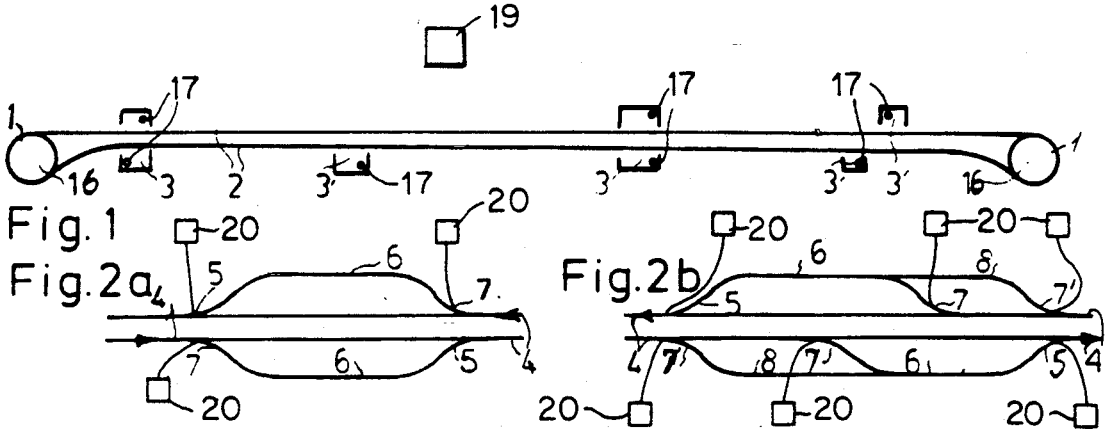
Fig. 1
Fig. 2a
Fig. 2b
Fig. 3a
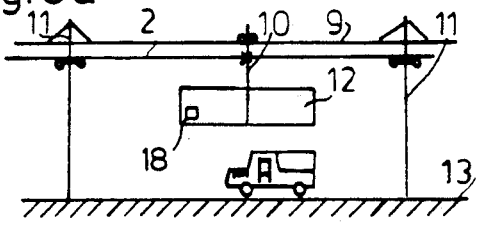
Fig. 3b
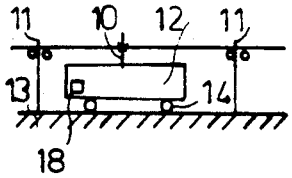
Fig. 4
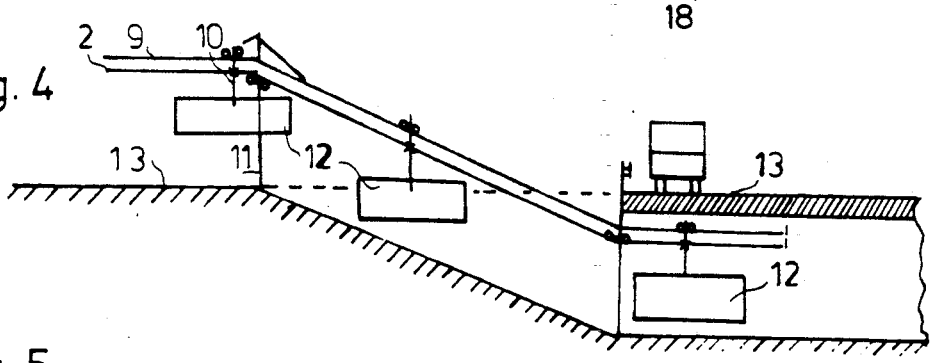
Fig. 5
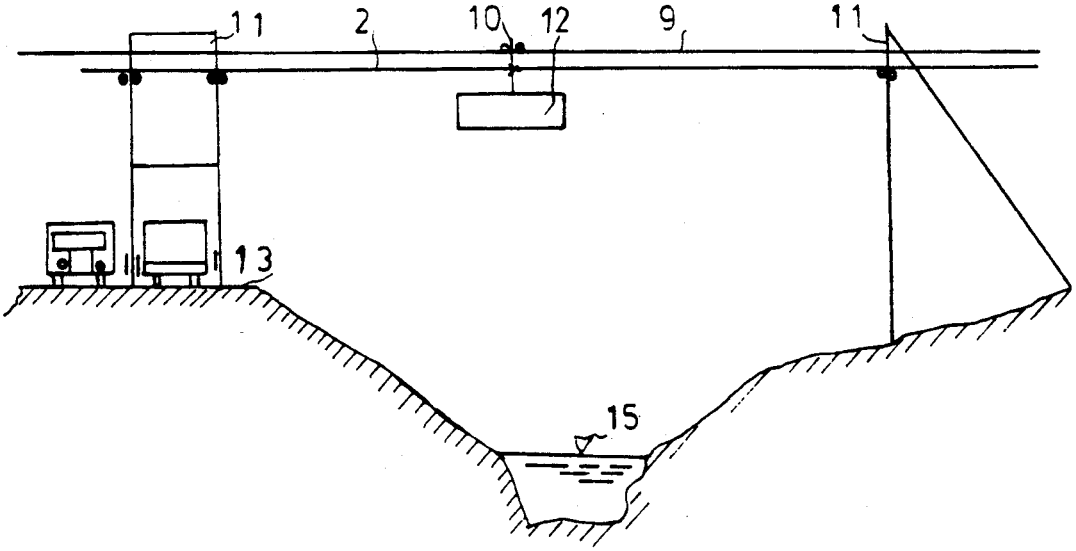

TRANSPORTATION SYSTEM FOR CITY TRANSPORTATION WITH TRACTION CABLE AND RAILROAD SYSTEM HAVING A CENTRAL ROUTING CONTROL AND ELECTRONIC CALLING SYSTEMS IN THE STATIONS

This is a continuation-in-part application of U.S. Ser. No. 07/697,101 filed May 8, 1991, now abandoned.

FIELD OF THE INVENTION

The present invention relates to a transportation system for city transportation with a two-track rail system extending above the car and forming the main line and having the capability of permitting cars on the main line to pass cars stopped in the stations.

BACKGROUND OF THE INVENTION

Transportation systems are known in which two cars are operated in shuttle operation between two end positions and potentially have a middle station at the place at which they meet. These known transportation systems are in general operated from cableways or suspension cableways as well as on mountain railways. Such a known system is the type of ATP 383.783, whose disadvantage resides in the motion coupling of the opposite car and the relative incapacity for adaptation to the required frequency.

In order to create greater latitudes, continuous cableways with cars capable of being coupled were developed wherein the traffic took place between two end positions. If several stations were required, several rails were connected one behind the other such that transfer could take place in the intermediate station or the entire path could be driven by one car via change-over paths. This system is disadvantageous because of the necessity for a station at the end positions and the power driving of each section of its own, even though they could be placed together in a common intermediate station and the large requirement for personnel because of it.

Further, rail-bound transportation systems in city transportation are known which, however, due to the street traffic are susceptible to interferences and in the case of being disposed in a second traffic level are implemented as subway trains or express railway systems. Such transportation means, however, are only usable with high passenger frequency. However, such a solution is not practical in relatively small cities, which also have traffic problems which must be solved not only in an environmentally friendly way but also in a manner keeping with the traffic conditions.

SUMMARY OF THE INVENTION

The present invention relates to an electronic calling system installation, such that the station selection devices for the target station are disposed in the cars, and that the car ready to depart from the station by means of a towing drive known per se can be transferred to the main line and is adapted to be coupled to an endless traction cable known per se and disposed along the main line.

The invention allows an at least partial roadway-independent scheduled regular taxiing traffic on a second traffic level wherein in place of a car driver, a personnel-saving automated control is possible which in the final analysis allows in terms of fees a transportation device competitive with mass transportation means and which due to the low-noise cable drive should also be viewed as reducing traffic noise.

An important advantage of the present invention over prior art devices is the type of drive means provided to move the cars in the rail system. In the present invention, the drive means may comprise an endless traction cable and a towing device. The endless traction cable drives the cars on the main line in the rail system, while the towing device transfers the cars from the main line onto the secondary line and from the secondary line back onto the main line. The secondary line leads into the stations and the storage tracks.

When a passenger in a car travelling on the main line indicates by means of the station selection device in that car that they want to disembark at a selected station, the towing device transfers the car from the traction cable onto the entrance shunt of the selected station. However, the cars remaining on the main line continue to move at the same constant speed. Thus, the deceleration of the car occurs in the station while the car is on the secondary line and not the main line. This is a significant advantage over prior art devices in which the deceleration of the car stopping in the station occurs on the main line because all of the cars behind the stopping car must also decelerate in the vicinity of the station.

The rail system of the present invention has two ends between which are arranged along either side of the rails. Cars run independently in the rail system and stop in the stations to pick-up and discharge passengers. The rail system comprises a secondary line and a main line forming a path which allows cars travelling on the main line to pass other cars travelling on the secondary line. The secondary line is connected at opposite ends to the main line and passes through the stations.

The rail system of the present invention also includes a central control, an electronic calling system installed in each station, and station selection devices disposed in each car. The electronic calling systems are connected to the station selection devices such that a car is guided into one of the stations when the electronic calling system in that station is activated. The station selection devices also cooperate with the central control to ensure that the station is ready to receive the car.

A towing device is utilized to transfer cars from the secondary line onto the main line, and an endless traction cable is disposed along the main line. The cars are coupled to the traction cable when the cars travel on the main line. The endless traction cable drives the cars on the main line between the ends of the rail system.

BRIEF DESCRIPTION OF THE DRAWINGS

The following drawings are illustrative of embodiments of the invention and are not meant to limit the scope of the invention as encompassed by the claims.

FIG. 1 shows a top view of the transportation system in accordance with the invention.

FIG. 2 shows in the partial switching diagrams a and b in each instance one station.

FIG. 3*a* represents a partial representation of the transportation system in an area above ground.

FIG. 3*b* represents another partial representation of the transportation system in an area above ground.

FIG. 4 shows the transition of the rail system in accordance with the invention from an area above ground to an area below ground.

FIG. 5 shows the layout of the rail system line given by a carrier cable whereby a relatively great distance can be overcome without supports.

DETAILED DESCRIPTION OF THE INVENTION

FIG. 1 provides a top view of a transportation system in accordance with the invention between two end stations 16 which comprise a reversing station and at which potentially a station 3 can be connected. The routing of the rail system itself is symbolized by an endless traction cable 2, reversing devices 1 for the traction cable 2, and a plurality of stations located between the end stations 16. The stations 3 can be disposed at any given distance on either side of the endless traction cable 2 in each direction of travel or also only on one side for one direction.

FIG. 2*a* depicts the traffic diagram of one station wherein the main line is denoted by 4 from which branches off a secondary track 6. The secondary track 6 is connected with the main line 4 by an exit shunt switch 5 and an entrance shunt switch 7. The vehicle can be briefly stopped on the secondary track 6 in order to accomplish embarking and disembarking of the passengers. While the vehicle is on the secondary track 6, other vehicles travelling on the main line 4 can pass by the stopped vehicle. In a preferred embodiment, the main line 4 can also comprise rails on at least a portion of the routing.

In order to also allow for the possibility of storing a car or cars for longer periods of time, FIG. 2*b* shows an embodiment of the present invention wherein a car storage 8 is located in an extension of the secondary track 6. The car storage 8 is connected with the main line 4 through a second entrance shunt 7' so that empty cars can be stored in the area of the station until they are required again.

In another embodiment, the secondary track 6 can be parallel to the main line and arranged either above or below the main line, preferably in the same vertical plane. The secondary track 6 can comprise two separate track sections connected one behind the other and separated by the entrance and exit shunt switches. The first track section of the secondary track 6 can be used as a storage area and the second track section can be used as a station track leading into the station. The cars on the secondary track 6 travel independently of the cars running on the main line 4 and can be integrated into the cars running on the main line 4 by means of the towing device 20, which is connected with friction wheels, and the endless traction cable 2. The towing device 20 functions to transfer cars between the secondary line and the main line.

FIG. 3*a* depicts a rail section in which the vehicle is moved as a suspended car 12. In this embodiment, the rail system is located above the cars. Each car has a station selection device 18. The station selection device 18 functions so that passengers may choose the station they want to arrive at. The selected station, or target station, is any station in the rail system at which the passengers choose to disembark, for example.

The car is suspended from a carrier rail 9 fastened on supports 11 via means 10 wherein the traffic is routed under the floor of the car 12. The endless traction cable 2 is disposed underneath the carrier rail 9.

FIG. 3*b* depicts a variant of the rail section shown in FIG. 3*a* wherein the car 12 is moved on rollers 14 on the ground 13. The car 12 is driven by a traction cable laid out above the car 12.

In FIG. 4, the transition of an above-ground travelling road to a below-ground travelling road is depicted wherein due to the suspension, the floor of car 12 remains always level in the manner of a suspension cableway. Through this measure, the transportation system can be guided practically invisibly and independently of the slope even through a protected landmark zone, for example the old part of town, without the remaining traffic suffering in the process.

FIG. 5 depicts a further variant of FIG. 3 in which the car 12 moves on a carrier cable 9' so that clefts in the ground such as, for example, river beds 15 or valleys can be traversed practically without supports.

Through the free arrangement capabilities of the secondary track 6 the station buildings can be simplified by omitting stairwells, elevators etc. and the passengers can step directly from the sidewalk onto the platform or into the cars which then stop at ground level. By disposing the carrier rails in double tracks the transverse swaying of the car is reduced whereby further safety during embarking and disembarking results without increasing personnel.

Referring to FIGS. 1–3, an electronic calling system 17 is installed at the bottom of each station 3 in the rail system. Briefly, this electronic calling system 17 functions to register a request for a car to stop in the station so that a passenger waiting in the station will be able to board the car and travel within the rail system. This is accomplished by the electronic calling system 17 working in cooperation with a central control 19. The central control 19 coordinates the location of the cars in the rail system and the status of the cars, i.e. whether they are full or have space to pick up waiting passengers in the stations.

The electronic calling system 17 in the station is also connected to the station selection devices 18 in the cars which not only guides a particular car into the selected target station, but also ensures the receiving readiness of the car with respect to the target station via the central control 19. Furthermore, the cooperation of the central control 19 and the station selection device 18 permits the transfer of the car from the secondary line into the traffic stream on the main line in such a manner that a minimum distance of the individual cars is ensured. The towing device belonging to the station is also controlled by the central control 19. Thus, the central control 19 operates to cause the next car with available space to seek the desired target station, e.g. in order to pick up or discharge passengers. The central control 19 replaces the station personnel so that only central monitoring is required.

In the present invention, the important parts of the electronic control system are: 1) the station selection devices 18 installed in each of the cars 12, 2) the electronic calling system 17 installed in each of the stations and 3) the central control 19 of the entire transportation system.

The station selection devices 18 for the target stations are disposed in each of the individual cars 12 running in the rail system. By means of the station selection devices 18, it is possible to select a desired or selected station, thus, it is a station selection device. It is designed so that when a passenger enters the car, they will be able to arrive at the station that they wish to arrive at (the "target station") by operating the station selection device 18 to select the desired station.

The electronic calling system 17 is connected to the station selection devices 18 and there is one such system in each station in the transportation system. The calling system 17 serves to bring a car with empty space or an empty car into the station in which the call was made. By means of the calling system 17, a passenger who wants to use the transportation system "calls" a car to come to the station to pick them up. The next available car with available space to come into the station and allow a passenger to enter into the car.

The third element of the transportation control system in the present invention is the central control 19 which is designed to operate in conjunction with the electronic calling system 17 in each station in order to ensure that at all times in each station a car is in a waiting position and able to respond to the "call" and receive a passenger. Thus, the function of the central control 19 is to cause the next car with available space to seek the desired target station.

The central control 19 is also connected to the station selection devices 18 in each car in order to ensure the receiving readiness of the car with respect to the target station via the central control 19. Thus, the central control 19 operates in conjunction with both the station selection devices 18 and the electronic calling system 17.

In addition, the central control 19 functions to keep track of the location of the cars in the system, whether on the main line or in storage, and to keep track of the occupancy of the cars, i.e. whether the cars are full, have available space, or are completely empty and ready to be put into storage.

A representative operation of the use of the present invention for travel between an initial station and a desired target station would be as follows: (1) a person located in an initial station would activate the electronic calling system 17; (2) the electronic calling system 17 would cooperate with the central control 19 and indicate to the central control 19 that a car is needed at that station; (3) the central control 19 would direct the next available car with available space, or an empty car from a storage area, into the station where the person was waiting; (4) after the car arrived at the station, the person would enter the car and activate the station selection device 18 disposed in each car; (5) by means of the station selection device 18, the person would indicate their destination (i.e., the target station); (6) the station selection device 18 in the car would then cooperate with the central control 19 to ensure that the target station is ready to receive the car, i.e. the target station is not full or out of service; and (7) when the selected station is reached, the car would depart from the main line and enter into the station.

The cycle of calling a car, either travelling in the rail system or in storage, to a station to pick up a passenger via the electronic calling system 17 in each station, and the passenger, after entering the car that arrives in the station, selecting a station via the station selection device 18 in each car, is frequently repeated throughout the transportation system. The central control 19 coordinates the movement, location and storing of all of the cars in the system.

The electronic control system described above is similar to that used in many other common apparatuses. These common apparatuses contain the basic elements of a central control, a electronic calling means and a station selection device in use for a transportation system.

For example, the operation of the electronic control system in the present invention is similar to that of a typical elevator control system. An elevator system is a transportation system in the sense that it moves people in a vertical plane between different floors in a building, as opposed to movement in a horizontal plane in the present invention. People enter the elevator at one floor and are desirous to reach another floor. By either an upward vertical movement or a downward vertical movement, the people reach the desired floor.

In a typical elevator system, people will call or order a car by pressing a button, or other similar electronic calling system, in the direction they want to travel. The next car with available space that is heading in the direction the people want to travel will stop at the floor and then they will enter into that elevator. Once inside the elevator, the people will select the floor, or station, they want to arrive at by means of a floor selection device. When the elevator reaches the desired floor, or target floor, it will stop so that the people can disembark from the elevator. The elevator is controlled by a central control that keeps track of the location of the elevators, the direction of the elevators and the occupancy of the elevators, i.e. whether the elevator cabs have available space, are empty or are full.

The control system described in the present invention is similar to the above described operation of a standard elevator control system. The elevator call buttons on each floor of a building (by means of which an elevator cab is called to the floor to pick up a passenger) is equivalent to the 'electronic calling system' in the present invention. The button panel located inside the elevator (on which a person indicates the floor they want to arrive at) is equivalent to the 'station selection device' in the present invention.

In the elevator system, the central control, or group controller in situations where there are multiple elevators serving one common path, is comparative to the 'central control' of the electronic control system in the present invention.

A sample elevator control system that may be adapted for use in the present transportation system is described in U.S. Pat. No. 4,308,935. In this prior art invention, an elevator control system is described in which the basic elevator control functions are set forth in Column 3, lines 4–32. When compared with the present invention, the operation of this elevator system is very similar and has specific elements that perform substantially the same functions as the elements in the present invention.

With respect to the electronic calling system 17 located in each station in the present invention, the hall call buttons 18–20 in the '935 patent (as displayed in FIG. 1) perform a similar function in that a call is placed for a car to stop at that position to pick up a passenger.

With respect to the station selection device 18 located in each car in the present invention, the car controller 16 in the '935 patent (as illustrated in FIG. 1) performs a similar function to provide operation and motion control to the car, i.e. directing the car to stop at a floor where a passenger desires to disembark (col. 3, lines 7–8).

With respect to the central control 19 in the present invention, the group controller 17 in the '935 patent (as illustrated in FIG. 1) performs substantially the same function by receiving the hall calls registered on the hall call buttons (the electronic calling system) and allocating those calls to various cars for response according to a selected mode of operation (See Col. 3, lines 8–15). Likewise, in the present invention, the central control receives the "calls" from the electronic calling system and, as per the selected mode of operation, ensures that the next car with available space stops at the station where the call originated.

Additional representative elevator control systems known in the art and adaptable for use in the present invention are described in U.S. Pat. Nos. 4,147,235 and 4,662,479, e.g., variations of a basic elevator system. Of course, any number of other elevator control systems might be used in the invention.

It is emphasized that the above-described control systems are not meant to be exclusive. There are numerous other variations of control systems known to those skilled in the art which could be adapted for use in the transportation system described in the present invention.

The examples provided above are not meant to be exclusive, many other variations of the present invention would be obvious to those skilled in the art, and are contemplated to be within the scope of the appended claims.

What is claimed is:

1. A transportation system for city transportation having a two-track rail system, comprising a rail system having a first end and a second end, a plurality of cars running independently on said rail system, a plurality of stations arranged between said first end and said second end and along said rail system, said rail system structured and arranged to allow said cars to stop in said stations for the pick-up and discharge of passengers, said rail system comprising a secondary line and a main line, a path is formed by said secondary line and said main line which allows cars travelling on said main line to pass other cars on said secondary line, said secondary line being connected at opposite ends to said main line and passing through said stations, a central control, an electronic calling system installed in each of said stations, station selection devices arranged in said cars, said electronic calling system in each of said stations being connected to said station selection devices such that one of said cars is guided into one of said stations when said electronic calling system in said one of said stations is activated, and said station selection devices cooperating with said central control to ensure the receiving readiness of said one of said cars, a towing device structured and arranged to transfer said cars from said secondary line onto said main line, and an endless traction cable arranged along said main line, said car being coupled to said traction cable when said cars are arranged on said main line, said endless traction cable structured to drive said cars on said main line between said first end and said second end of said rail system.

2. The transportation system as claimed in claim 1, wherein said main line comprises rails on at least a portion of said path, said rails being structured and arranged above said cars for carrying said cars in said rail system.

3. The transportation system as claimed in claim 1, wherein said rail system extends above said cars and said cars are suspended therefrom.

4. The transportation system as claimed in claim 3, wherein said endless traction cables are substituted for said rails.

5. The transportation system as claimed in claim 3, wherein said cars are further supported by means of rollers and said endless traction cable drives said cars to move at ground level by means of said rollers.

6. The transportation system as claimed in claim 1, wherein said main line having a first side and a second side, said secondary line including secondary tracks arranged on at least one of said first and said second side of said main line and said secondary line having two entrance shunts and one exit shunt connecting said secondary tracks to said main line, said secondary tracks thereby defining a storage path for empty cars.

7. The transportation system as claimed in claim 6, wherein said secondary tracks are parallel to said main line in said stations and said secondary tracks comprise two track sections connected one behind the other, said track sections being separated by said entrance and exit shunts.

8. The transportation system as claimed in claim 7, wherein said secondary tracks comprise a first track section implemented as a storage area for empty cars and a second track section implemented as a station track, wherein said cars on said second track section travel independently of said cars running on said main line and said cars on said second track section being capable of being integrated into said cars running on said main line by means of said towing device and said endless traction cable.

9. The transportation system as claimed in claim 6, wherein said secondary tracks are arranged parallel to and arranged above said main line such that passengers can enter said cars from a street level without staircase facilities.

10. The transportation system as claimed in claim 6, wherein said secondary tracks are arranged parallel to and arranged below said main line such that passengers can enter said cars from a street level without staircase facilities.

11. The transportation system as claimed in claim 6, wherein at least one of said cars is kept on said secondary track ready to depart in each of said stations.

12. A transportation system, comprising a two-track rail system including a main line and a secondary line, an endless traction cable arranged along said main line, a plurality of cars driven by said endless traction cable and running on said rail system, said cars being suspended from said rail system, a plurality of stations on said secondary line structured and arranged to allow said cars running on said main line to be called into said stations to stop for the pick-up and discharge of passengers, secondary tracks arranged in conjunction with said stations, said secondary tracks connected with said main line through two entrance shunts and one exit shunt, said secondary tracks each comprising a first track section implemented as a storage area for empty cars and a second track section implemented as a station track for the pick-up and discharge of passengers, wherein said cars on said secondary track travel independently of said cars running on said main line and ar capable of being integrated into said main line by said endless traction cable and an electronic communication system comprising an electronic calling system installed in each of said stations, station selection devices arranged in said cars, and a central control, wherein said electronic calling system and said station selection devices act in cooperation with said central control to call a particular one of said cars traveling on said main line to stop at a desired one of said stations and a particular one of said cars stored on one of said secondary tracks can be transferred onto said main line.

13. The transportation system as claimed in claim 12, wherein said cars running on said main line are structured and arranged to pass said stations without stopping.

* * * * *